US005368451A

United States Patent [19]

Hammond

[11] Patent Number: 5,368,451

[45] Date of Patent: Nov. 29, 1994

[54] METERING PUMP

[76] Inventor: John M. Hammond, 6172 Knickerbocker Rd., Ontario, N.Y. 14519

[21] Appl. No.: 973,064

[22] Filed: Nov. 6, 1992

Related U.S. Application Data

[63] Continuation-in-part of Ser. No. 710,323, Jun. 4, 1991, Pat. No. 5,205,722.

[51] Int. Cl.[5] ..... F04B 45/06; F04B 1/06

[52] U.S. Cl. ..... 417/395; 417/275; 91/491

[58] Field of Search ..... 417/395, 273, 383; 91/491

[56] References Cited

U.S. PATENT DOCUMENTS

| | | | |
|---|---|---|---|
| 2,612,837 | 10/1952 | Midgette | 417/273 |
| 2,673,525 | 3/1954 | Lucas | 417/203 |
| 3,213,804 | 10/1965 | Sobey | 417/395 |
| 3,937,400 | 2/1976 | Krause | 239/3 |
| 4,068,641 | 1/1978 | Johnson | 417/395 |
| 4,269,569 | 5/1981 | Hoover | 417/347 |
| 4,556,371 | 12/1985 | Post | 417/539 |
| 4,687,426 | 8/1987 | Yoshimura | 417/539 |
| 4,790,732 | 12/1978 | Yamatani | 417/539 |
| 4,844,706 | 7/1989 | Katsuyama | 417/395 |

*Primary Examiner*—Richard A. Bertsch
*Assistant Examiner*—Peter Korytnyk
*Attorney, Agent, or Firm*—Howard J. Greenwald

[57] ABSTRACT

An apparatus for pumping fluid at a substantially constant flow rate, is disclosed. The apparatus contains three transducers which couple one hydraulic fluid to another fluid while preventing contact with said other fluid. The apparatus also contains a timing device for continuously and sequentially withdrawing hydraulic fluid from the first fluid transducer while simultaneously pumping hydraulic fluid to the second fluid transducer, thereafter withdrawing hydraulic fluid from the second fluid transducer while simultaneously pumping hydraulic fluid to the third fluid transducer means, and thereafter withdrawing hydraulic fluid from the third fluid transducer. The timing means preferably includes a plurality of hydraulic cylinders and pistons, and a cam assembly.

19 Claims, 9 Drawing Sheets

FIG. 9A
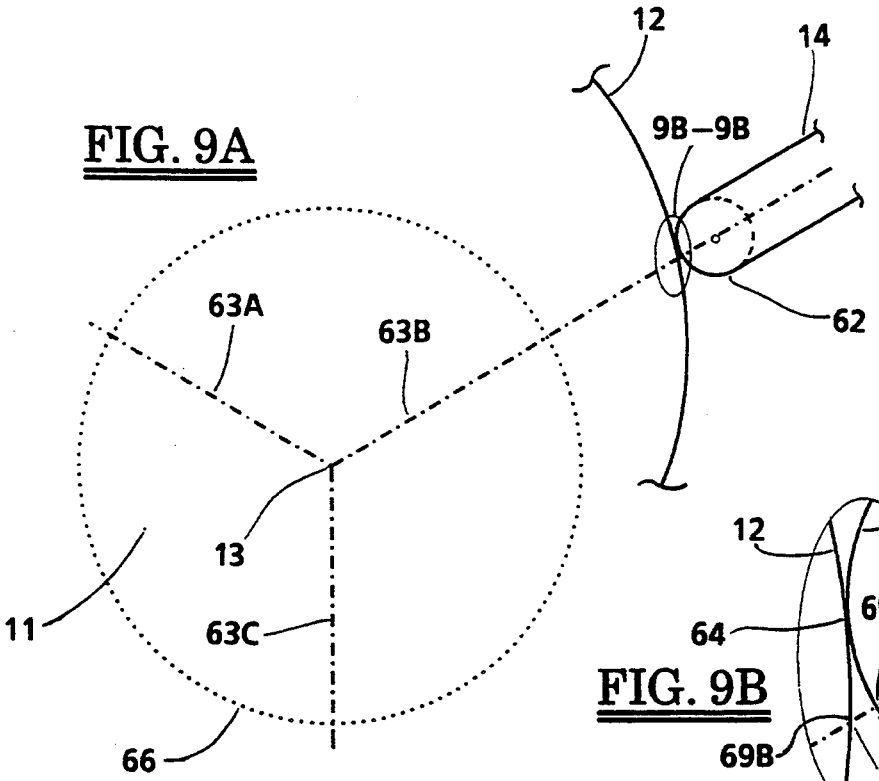
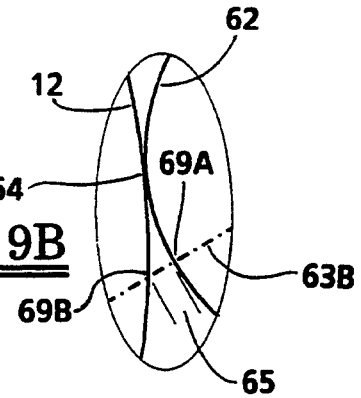
FIG. 9B
FIG. 9C
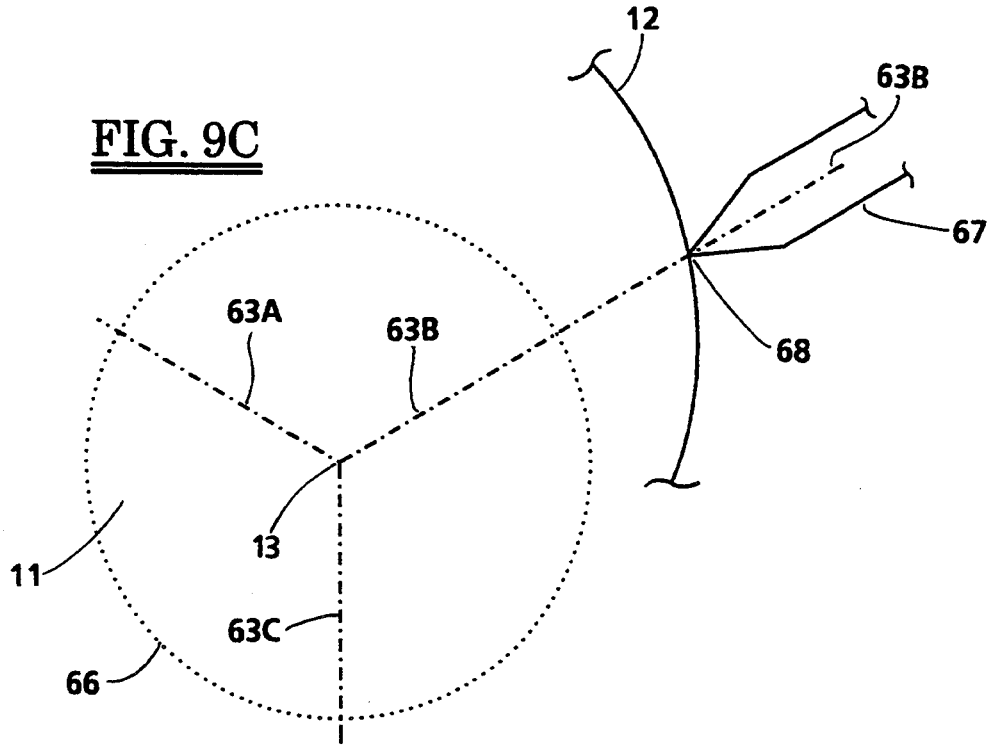

METERING PUMP

CROSS-REFERENCE TO RELATED PATENT APPLICATION

This application is a continuation in part of my copending application Ser. No. 07/710,323, filed Jun. 4, 1991, now U.S. Pat. No. 5,205,722.

FIELD OF THE INVENTION

A metering pump comprised of a rotating cam, cam followers, hydraulic cylinders, fluid transducers, and flow direction control valves is disclosed. This metering pump assembly may be used to continuously provide fluid flow at a substantially constant flow rate.

BACKGROUND OF THE INVENTION

Pumping devices for supplying material to various types of machines are well known to those skilled in the art. However, to the best of applicant's knowledge, no such device is available which provides fluid at a substantially constant flow rate, provides reliable, long-term operation when used with abrasive or corrosive or viscous fluids, and minimizes the risk of leakage, ignition, or explosion of the pumped fluid or its vapors.

One prior art device was described in July of 1989, in U.S. Pat. No. 4,844,706 of Kazuo Katsuyama et al. In discussing the problems with the use of prior art rotary pumps in systems where a constant flow rate was desired, Katsuyama disclosed (at column 1) that "... even if the rotary pump is driven at constant number of rotation, the flow rate of the coating material may vary due to the change in the pressure loss at the suction port or discharge port of the rotary pump depending upon the flowing state of the coating material ... and there has been a problem, e.g., in a two-component coating material that the main agent and the curing agent therefore cannot be supplied at an accurate mixing ratio."

According to Katsuyama et al., in addition to the uneven flow rate often caused by the use of a rotary pump, the use of such pump with viscous or abrasive fluids often caused a problem. Thus, at column 2 of the patent, he stated that the "... use of a gear pump may be considered for supplying a highly viscous paint under pressure. However, there has been a problem that the viscous coating material adheres and clogs at the bearing portion of the gear pump during long time operation to often interrupt the rotation of the pump. In addition, in the case of using a highly viscous paint, particularly a metallic paint, the metal ingredient is ground by the gear pump failing to obtain uniform coating quality."

The pumping system described in the Katsuyama et al. patent designed to solve these problems was complicated and expensive and contained at least two double-acting reciprocal pumping means, two rotary pumps, a plurality of on-off valves, timer means, a pressure control valve, and other mechanisms. However, it does not appear that the device of the Katsuyama et al. patent adequately solves either of the problems it discusses.

In the first place, it does not appear that the device of the Katsuyama et al. patent provides a substantially constant flow rate for the fluid being delivered over its entire cycle. As is disclosed at column 10 of the Katsuyama et al. patent, and illustrated in FIG. 2, the device of this patent contains two "hydraulically powered reciprocal pumps 3A and 3B;" fluid is delivered from one of such pumps until the material in such pump is substantially depleted (see from points T4 to T6 on FIG. 2), then the second of such pumps is turned on (see point T5 on FIG. 2) and fluid is delivered from it while fluid continues to be delivered from the first pump, and thereafter the first pump is turned off (see point T6 of FIG. 2) and then refilled with fluid (see from points T7 to T8 of FIG. 2); after the fluid in the second pump is substantially depleted, the cycle is repeated. At the point in the cycle where one of the pumps is turned off (see, e.g., points T6 or T10 of FIG. 2), the hydraulic fluid being furnished to side 10 of the other pump (see FIG. 1) and the coating fluid being discharged from side 9 of the other pump must accelerate sharply in their respective fluid lines, thereby substantially changing the flow rate of such fluids. In the second place, it does not appear that the device of the Katsuyama et al. patent provides reliable, long-term operation when used with abrasive or viscous fluids; for the pumping device disclosed in the Katsuyama et al. patent contacts the fluid to be delivered with the working parts of at least one rotary pump (see column 5 of the patent). Furthermore, as indicated below in the discussion of the Prus et al. patent, the fact that the Katsuyama et al. device contacts the fluid to be delivered with the working parts of at least one rotary pump often changes the rheological properties of such fluid and/or creates an explosion or pollution hazard. The Prus et al. patent also recognized certain problems with prior art pumping systems. Prus et al. disclosed a coating product installation. The Prus et al. patent stated that, when prior art gear pumps were used for the delivery of paint or varnish, they were "... unreliable, requiring frequent adjustment of the pump flow-rate ... the component parts of the gear pump used under such conditions wear more rapidly... and ... this wear results in internal leakage .... In fact, such leakage exists even when the pump is brand new... (see from line 67 of column 1 to line 10 of column 2)." The solution provided by Prus et al. was to connect the gear pump used in his system to a means for delivering rinsing product and to periodically flush his pump. However, in addition to causing his pump to be out of the production cycle for substantial periods of time, the use of "rinsing product" with different rheological and chemical properties tended to damage the gears in the pump and the flow rate sensors used in the system. Prus et al. recognized that "... abrupt changes in operating conditions resulting from the succession of products of different kinds and of very different viscosities in the conduit..." may cause "... wear of and damage to the flowrate sensor" (see Column 4, lines 19–29). However, the pumping device disclosed in the Prus et al. patent contacts the fluid to be delivered with the working parts of at least one rotary pump (see, for example, column 3). It is well known that such contact is often undesirable. Thus, for example, the turbulence and mixing caused by rotary pumps may often change the theological properties of shear-sensitive materials, such as latex (see, e.g., page 3.55 of Igor J. Karassik et al.'s Pump Handbook, Second Edition, McGraw-Hill Book Company, New York, 1984). Thus, for example, some fluids and/or their vapors (such as organic peroxides) tend to explode when subjected to shock and/or vibration and thus should not be contacted with the moving parts or seals of a rotary pump. Thus, for example, some fluids may leak from the rotary pumps that they are in contact with, thereby creating pollution and/or explosion hazards.

There are other problems with the prior art pumping systems which are not mentioned by the Katsuyama et al. and the Prus et al. patents. Thus, for example, the pumping device of the Katsuyama et al. patent is comprised of several electrical control devices which appear to be capable of generating electrical discharges. It is known that certain pumpable fluids, such as hydrocarbon solvents, are readily ignited when subjected electrical spark discharges, which are often present in electrical motors, solenoid valves, and actuators. Thus, the device of the Katsuyama et al. patent might present a fire and/or explosion hazard when used with these ignitable and/or explosive fluids.

The systems described in the Katsuyama et al. and the Prus et al. patents utilize rotary pumps, with all of the disadvantages attendant thereto. However, other pumps also present problems when an attempt is made to use them for an application requiring a constant flow rate.

Thus, by way of illustration, U.S. Pat. No. 3,937,400 of Krause describes an apparatus for spraying paint. Krause discloses that, in such an apparatus, "The use of conventional diaphragm pumps is unsatisfactory because of the pulsating nature of the feed (see lines 27–29 of column 1)." A similar teaching is presented at pages 7–24 of James P. Poynton's "Metering Pumps" (Marcel Dekker, Inc. New York, 1983); and also at pages 8–36 of Horst Fritsch's "Metering Pumps Principles, Designs, Applications" (Verlag Moderne Industrie AG& Co., Lasdsberg, Germany 1989). Recent developments in reciprocating pumps have included countermeasures to minimize the pulsation of fluid flow through the use of multiple cams which drive their respective reciprocating elements in a manner in which individual pulsations are produced such that net sum of the pulsing flows is nearly constant. Three recent disclosures of this nature are U.S. Pat. Nos. 4,556,371 of Post; 4,687,426 of Yoshimura; and 4,790,732 of Yamatani. Each of these devices fails to achieve a constant pumping flow of liquid due to the fact that the combination of cams and cam followers disclosed in each of them inherently create pulsing fluid flows which do not sum to a constant flow rate. In addition, the reliability of these pumps would be unsatisfactory when pumping fluid of an abrasive or corrosive nature: each of them places the fluid to be pumped in direct contact with components of the pump which are fabricated according to high precision manufacturing tolerances, and thus are susceptible to damage by an abrasive, corrosive, or otherwise unsatisfactory fluid. Furthermore, each of these pumps uses a complex camshaft consisting of multiple cam lobes; this type of camshaft has a high manufacturing cost, and these cam lobes must be precisely positioned relative to each other to maintain a constant flowrate of fluid.

It is an object of this invention to provide a pumping apparatus which can continuously deliver fluid without contacting such fluid with the internal part or seals of a rotary pump. It is another object of this invention to provide a pumping apparatus which can continuously deliver fluid without passing such fluid in contact with or near any devices which could generate electrical discharges.

It is an object of this invention to provide a pumping apparatus which can continuously deliver viscous and/or abrasive and/or corrosive material at a substantially constant flow rate without the need for periodic rinsing.

It is another object of this invention to provide a pumping apparatus which, during its entire cycle, does not accelerate the fluid being pumped to the degree experienced in conventional reciprocating pumps.

It is another object of this invention to provide a pumping apparatus which does not subject the fluid being pumped to any substantial amount of shear.

It is an object of this invention to provide a pumping apparatus which can continuously delivery viscous and/or abrasive and/or corrosive material at a substantially constant flow rate which is substantially more reliable than prior art pumping devices.

It is another object of this invention to provide a pumping apparatus which is relatively uncomplicated and inexpensive.

It is an additional object of this invention to provide a novel timing means consisting of a cam and cam followers, the geometry of which results in reciprocating motion which can drive fluid at a constant flow rate.

It is yet another object of this invention to provide a novel pumping apparatus comprised of reciprocating elements which is capable of delivering fluid at a constant flow rate without contacting said fluid with any of the parts of the reciprocating elements.

SUMMARY OF THE INVENTION

In accordance with this invention, there is provided an apparatus for continuously pumping fluid at a substantially constant flow rate. This apparatus is comprised of a rotating camshaft with at least one cam lobe, at least three reciprocating cam followers, at least three hydraulic pistons, at least three fluid transducers, and means for allowing fluid flow into and out of said fluid transducers.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 9A is an axial view of the contact of a roller type cam follower with a cam lobe of the applicant's invention;

FIG. 9B is a detailed rendering of the actual contact point of a cam follower with a cam lobe shown in FIG. 9A;

FIG. 9C is an axial view of the contact of a knife edge cam follower with a cam lobe of the applicant's invention.

DESCRIPTION OF THE PREFERRED EMBODIMENTS

Figure 1A:
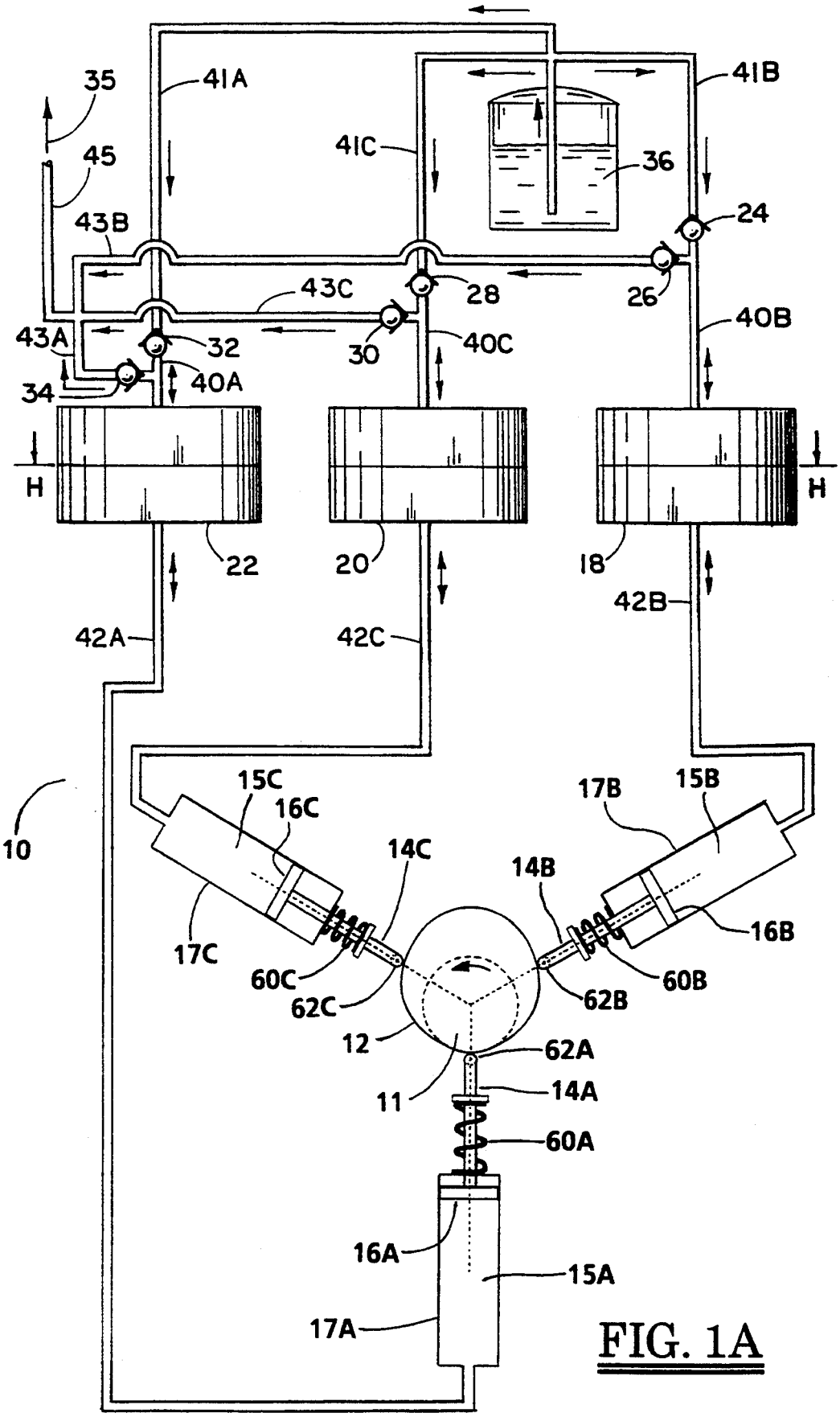
FIG. 1A is a schematic diagram of one preferred embodiment of applicant's system.

FIG. 1A is a schematic of one preferred embodiment of applicant's invention. Referring to FIG. 1A, it will be seen that applicant's metering pump 10 is preferably comprised of cam drive shaft 11, cam lobe 12 , cam followers 14A, 14B, 14C, hydraulic pistons 16A, 16B, 16C, hydraulic cylinders 17A, 17B, 17C, fluid transducers 22, 18, and 20, valving means 24, 26, 28, 30, 32, and 34, and process fluid reservoir 36.

Referring to FIG. 1A, cam drive shaft 11 rotates cam lobe 12 which alternately displaces cam followers 14A, 14B, and 14C outward and inward in a radial direction. Said cam followers 14A, 14B, and 14C are suitably coupled to hydraulic pistons 16A, 16B, and 16C which reciprocate along the axes of hydraulic cylinders 17A, 17B, and 17C, respectively. Conventional sealing means is provided on hydraulic pistons 16A, 16B, and 16C to prevent any leakage of fluid around hydraulic pistons 16A, 16B, and 16C as they move within the bores of hydraulic cylinders 17A, 17B, and 17C. The motion of hydraulic pistons 16A, 16B, and 16C within hydraulic cylinders 17A, 17B, and 17C alternately discharges hydraulic fluid out of, and intakes hydraulic fluid into cylindrical cavities 15A, 15B, and 15C. Cylindrical cavities 15A, 15B, and 15C are suitably coupled to fluid transducers 22, 18, and 20 via conduit means 42A, 42B, and 42C. Thus said alternating discharge and intake of hydraulic fluid from cylindrical cavities 15A, 15B, and 15C results in a corresponding intake and discharge of hydraulic fluid from fluid transducers 22, 18, and 20, thereby causing a corresponding intake of process fluid contained in reservoir 36 to flow through conduits 41A, 41B, and 41C, through valve means 32, 24, and 28, into fluid transducers 22, 18, and 20; and to be subsequently exhausted through valve means 34,26, and 30, then flowing through conduits 43A, 43B, and 43C, and subsequently through conduit 45 to a desired location indicated by arrow 35.

In the operation of the applicant's pump, cam followers 14A, 14B, and 14C, are maintained in continuous contact with cam lobe 12 via the use of spring means 60A, 60B, and 60C suitably operatively connected to cam followers 14A, 14B, and 14C, and in contact with hydraulic cylinders 17A, 17B, and 17C. The contact between cam followers 14A, 14B, and 14C and cam lobe 12 may be through roller means 62A, 62B, and 62C, or alternatively cam followers 14A, 14B, and 14C may be in direct contact with cam lobe 12. Cam drive shaft 11 is rotated through conventional electric motor and control means shown in FIG. 1B, or other suitable means.

Figure 1B:
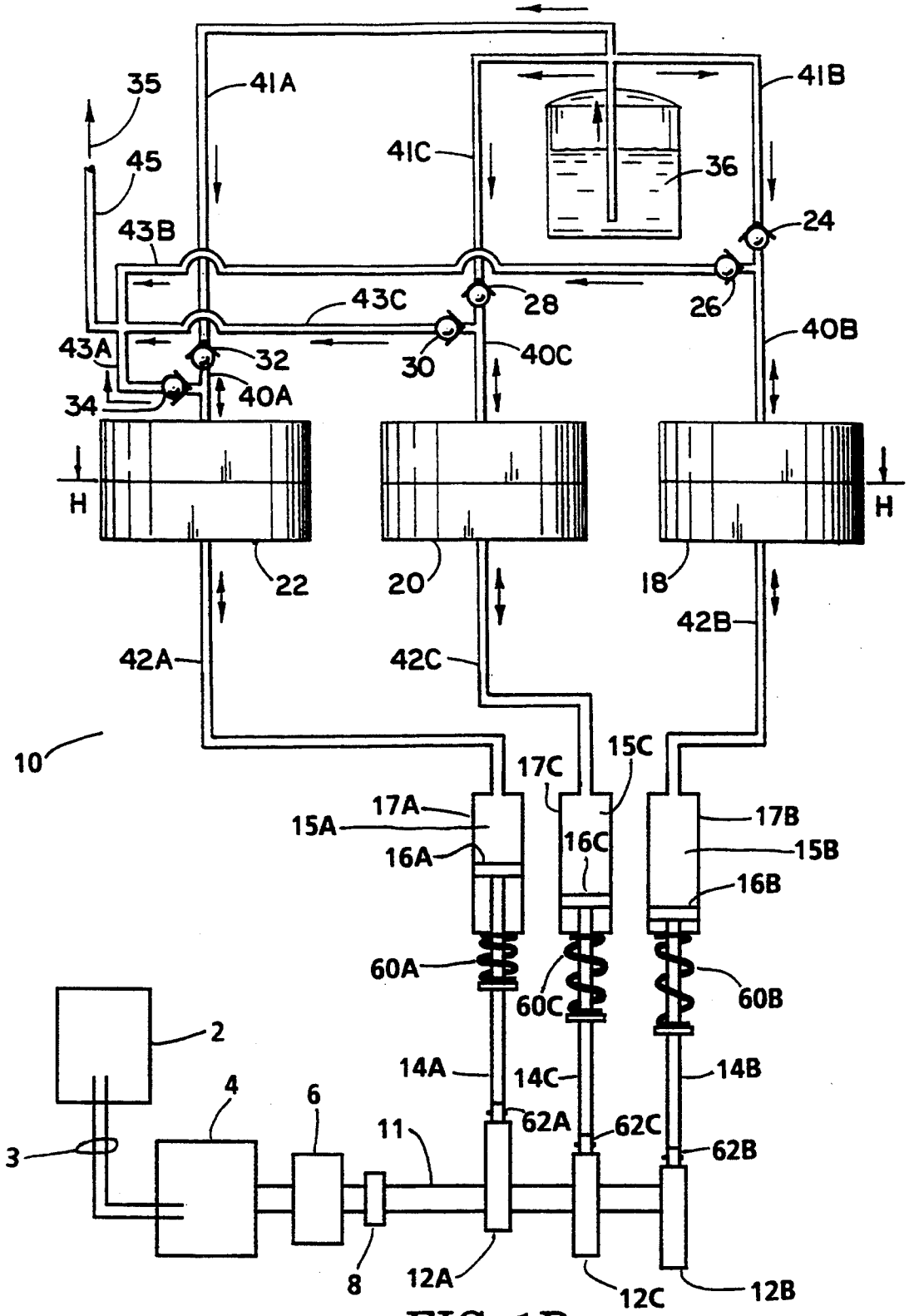
FIG. 1B is a schematic diagram of an additional embodiment of applicant's system.

FIG. 1B is an alternative embodiment of the applicant's invention. Referring to FIG. 1B, it will be seen that in this embodiment, the radial displacement of cam followers 14A, 14B, and 14C by the rotation of cam drive shaft 11 is accomplished via respective contact with cam lobes 12A, 12B, and 12C. The remaining functions in this embodiment are accomplished through identical means to those described in the applicant's preferred embodiment shown in FIG. 1A. In FIG. 1B, a drive means to rotate cam drive shaft 11 is also depicted: motor 4 is suitably connected to gear reducer 6 which in turn is connected to cam drive shaft 11 via flexible coupling 8. Speed control and motor power supply means 2 is connected to motor 4 with wiring 3.

Figure 2:
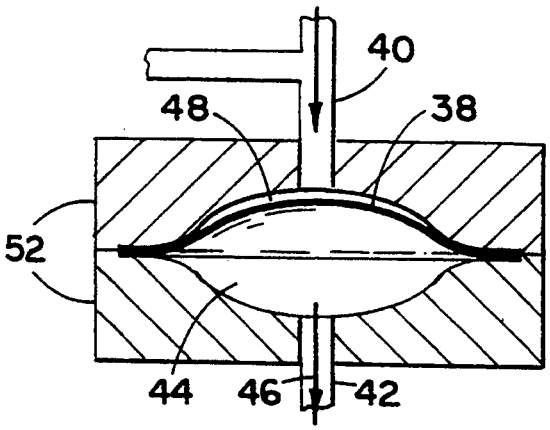
FIGS. 2, 3, 4, and 5 are sectional views of a preferred fluid transducer used in the embodiment of FIG. 1, showing said transducer at different stages of a pumping cycle.

FIG. 2 is a sectional view of a preferred embodiment of fluid transducer 18. Fluid transducers 20 and 22 preferably have a similar configuration.

Referring to FIG. 2, it will be seen that fluid transducer 18 provides a means for coupling one fluid to another without either fluid contacting the other.

Any of the fluid transducers known to those skilled in the art may be used as fluid transducer 18 and/or 20 and/or 22. Thus, by way of illustration and not limitation, one may use fluid transducer 3A or 3B of Katsuyama et al.'s U.S. Pat. No. 4,844,706, the disclosure of which is hereby incorporated by reference into this specification. Thus, by way of further illustration, one also may use the fluid transducer described in U.S. Pat. No. 3,937,400 of Krause, the disclosure of which is also hereby incorporated by reference into this specification. The Krause transducer comprises a diaphragm assembly comprising a casing, a flexible impermeable diaphragm sealed across the casing to define a pumping chamber and a pressurizing chamber separated from one another by the diaphragm, porting to the pressurizing chamber for the introduction and discharge of a pressurized fluid, porting to the pumping chamber for the introduction and discharge of paint, and means for supplying a predetermined volume of pressurized fluid to the pressurizing chamber, whereby said diaphragm is flexed so as to discharge an equivalent volume of paint from the pumping chamber.

By way of further illustration, fluid transducers are also described on pages 12–18 of James P. Poynton's "Metering Pumps," supra. Thus, one may use the disc diaphragm liquid end, the single tubular diaphragm liquid end, the double tubular diaphragm liquid end, the disc/tubular diaphragm liquid end, and the double disc diaphragm liquid end fluid transducers described therein. By way of further illustration, the fluid transducer may comprise a piston and cylinders; such a device is described in the aforementioned Krause patent and in U.K. patent Application No. 5237/63, the disclosure of which is hereby incorporated by reference into this specification. Such a device is also described in U.S. Pat. No. 4,946,100 of Fleming et al. (see column 4), the disclosure of which is also hereby incorporated by reference into this specification. Referring again to FIG. 2, it will be seen that each of fluid transducers 18, 20, and 22 is comprised of a diaphragm 38. This diaphragm 38 separates fluid in line 40 from fluid in line 42.

Figure 3A:
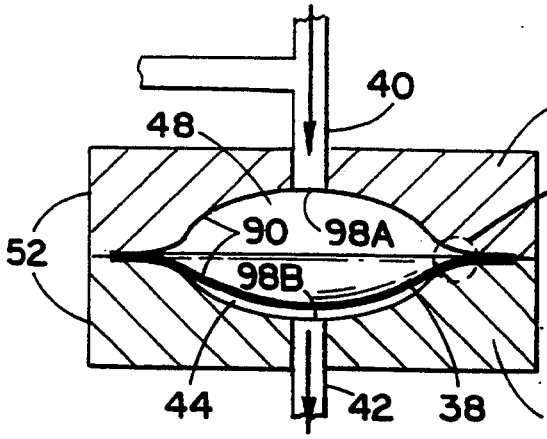
Figure 3B:
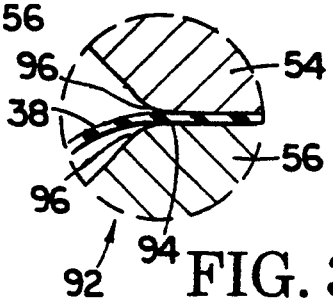

When fluid is withdrawn from cavity 44 via line 42, the diaphragm 38 is displaced downwardly in the direction of arrow 46, thereby drawing fluid from reservoir 36 (not shown in FIG. 2) into cavity 48 via line 40. As illustrated in FIG. 3, when diaphragm 38 has been displaced downwardly to substantially its maximum extent, the volume of fluid in cavity 48 substantially exceeds the volume of fluid in cavity 44. In general, in the preferred embodiment illustrated in FIG. 1, the ratio of the volume of fluid in cavity 48 to the volume of fluid in cavity 44 will range from about 1:10 to about 10:1 over the entire pumping cycle.

Figure 4:
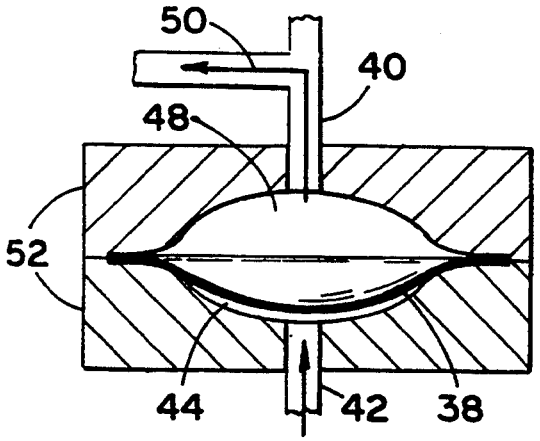
Figure 5:
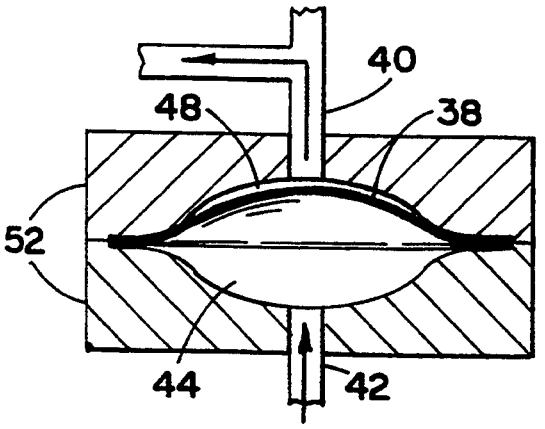

Referring to FIG. 4, when one wishes to reverse the cycle, fluid may be expelled from cavity 48 in the direction of arrow 50; one may expel such fluid by introducing hydraulic fluid at a higher fluid pressure via line 42 into cavity 44. As shown in FIG. 5, this will cause diaphragm 38 to return to substantially the same position as is shown in FIG. 2. The fluid transducer 18 preferably is comprised of a casing 52. Any material conventionally used as pump casings may be used as casing 52. It is preferred that casing 52 be resistant to physical and/or chemical degradation when exposed to the material being pumped, and that it also be easy to fabricate. Thus, by way of illustration, one may use stainless steel, "MONEL" (a corrosion-resistant alloy comprised primarily of nickel and copper with a very small percentage of carbon, manganese, iron, sulfur, and silicon, which is sold by Huntington Alloys of Huntington, W. Va.), "HASTELLOY" (a high strength, nickel-based, corrosion-resistant alloy sold by the Cabot Corporation of Kokomo, Ind.), "TEFLON" (a fluorinated polymer sold by the E.I. du Pont de Nemours and Company of Wilmington, Del.), and the like.

The casing 52 may be an integral assembly, comprised of casing halves 54 and 56 (see FIG. 3). It is preferred, however, that each of casing halves 54 and 56 be separately fabricated and that these halves be joined to each other by suitable means such as, e.g., adhesive means, clamps, bolts, and the like. When casing halves 54 and 56 are joined to each other, diaphragm 38 should be disposed between such casing halves and secured between the mating surfaces of such casing halves. The diaphragm 38 may consist essentially of any material conventionally used in diaphragms for such fluid transducers. It is preferred that the diaphragm consist of a material which is resistant to physical and chemical degradation when exposed to either the hydraulic fluid or the process fluid.

Some suitable materials which may be used for the diaphragm 38 include "TEFLON" "KALREZ" (a fluoroelastomeric rubber sold by E. I. du Pont de Nemours and Company), "VITON" (a fluoroelastomer based on the copolymer of vinylidene fluoride and hexafluoropropylene, which is sold by E. I. du Pont de Nemours and Company), and the like.

The diaphragm 38 may be from about 0.005 to about 0.05 inches. In one preferred embodiment, the diaphragm 38 is less than about 0.02 inches thick.

In one embodiment, not shown, the diaphragm 38 is a composite material comprised of a chemically and physically resistant material on its top surfaces and a material which need not be so resistant on its bottom surface; for only the top surface is contacted with the process fluid which can readily cause its chemical and/or physical degradation. By the same token, in another embodiment (not shown) casing half 54 is comprised of said chemically and/or physically resistant material, but casing half 56 need not comprise said material.

Each of casing halves 54 and 56 is comprised of an intake/output port, such as, e.g., port 40 (see FIG. 2); and each casing half contains, on its interior surface, a substantially bowl-shaped cavity.

The casing halves 54 and 56, when attached to each other, define a casing 52 which is comprised of intake/output ports 40 and 42 and which thus contain a pair of bowl-shaped cavities, the open sides of which face each other, and which are separated by the diaphragm 38; i.e., the bowl shape of the cavity of casing 56 is open upwards, and the bowl-shape of the cavity of casing 54 is open downwards, with these two cavities affixed immediately adjacent to each other and separated by diaphragm 38.

In one embodiment, not shown, casing half 54 is comprised of two separate pieces. In this embodiment, the top half of such casing is comprised of the casing material described above; and, as originally fabricated, it has substantially the same dimensions as the casing half 54. Thereafter, a portion of the bottom half of such casing is removed and replaced by a plate of suitably resistant material which is dimensioned identically to the material removed, so that the composite casing half 54 so produced has substantially the same dimensions as casing half 56. The plate so produced may then be attached to casing half 56 separately from the remaining portion of the upper casing by suitable means so that it will retain the diaphragm 38 intact and maintain sealed and undisturbed the hydraulic fluid contained in the hydraulic circuit shown below line H—H in FIGS. 1A,including lines 42A, 42B, and 42C, and cylindrical cavities 15A, 15B, and 15C. Such provisions are made to facilitate inspection of the diaphragm 38 and the upper casing half 54 in the event such inspection is necessary.

Referring again to FIG. 3, a preferred profile of curvature for surfaces 90 of the bowl-shaped cavities of casings 54 and 56 is described. In enlargement 92, point 94 represents the innermost position where the location of the diaphragm 38 is fixed by the clamping action of casings 54 and 56. Along further points inward on casings 54 and 56, a small radius of curvature 96 is fabricated, which effects the transition from the flat clamping surfaces at point 94 to the substantially bowl-shaped surfaces 90. From the radius of curvature 96, each surface 90 is comprised of a substantially circular arc.

In a preferred embodiment, for a bowl-shaped cavity of radius R, as measured from point 94 in enlargement 92 across its maximum diameter to a corresponding point (not shown) opposite point 94, the radius of curvature 96 was equal to 0.06 times R; the radius of the spherical arc comprising the remainder of surface 90 from its inner section with radius of curvature 96 at each end was 1.15 times R; and the resulting depth of the bowl-shaped cavity was approximately 0.55 times R. The benefit of this preferred geometry is when the diaphragm reaches close proximity to either upper or lower surface 90 during a fluid pumping operation (previously described), as the pumping proceeds further, the ring of contact of the diaphragm 38 around the bowl-shaped cavities of either casings 54 of 56 along surfaces 90 will begin at point 94, move sequentially along radius of curvature 96, and proceed inward to the center of the bowl where fluid is expelled from the outlet from the cavity (in FIG. 3, cavity 44 and bowl center point 98B). Such a progression results in minimal stresses on diaphragm 38 while simultaneously enabling complete and repeatable expulsion of process or hydraulic fluid from the transducer 18, which is beneficial when using transducer 18 in a batch delivery mode.

In a further embodiment, not shown, small grooves approximately 0.12 inch wide by 0.06 inch deep, are cut into surfaces 90 of FIG. 3, running from centerpoint 98A and 98B of casings 54 and 56 radially outward along a length of $0.75 \times R$; said grooves are spaced around the bowl-shaped surface 90 at 45 degree intervals. In addition, at centerpoints 98A and 98B where ports 40 and 42 are connected to cavities 44 and 48, respectively, a plurality of small holes, typically 0.06 inch diameter, are provided to achieve said connection through surface 90. These features also facilitate complete expulsion of fluid from transducer 18 and result in minimal stress on membrane 38 when it achieves total contact with either of surfaces 90. Said features are beneficial when using transducer 18 in a batch delivery mode.

In the embodiments of the applicant's invention depicted in FIGS. 1A and 1B, the sum of the rates of hydraulic fluid flow being delivered into transducers 18, 20, and 22 and the sum of the rates of hydraulic fluid flow being withdrawn from transducers 18, 20, and 22 is maintained constant for any constant operating speed of rotation of cam drive shaft 11. This is accomplished by contacting the cam followers 14A, 14B, and 14C with cam lobe 12 such that the cam followers are operated in identical cycles of radial displacement which are separated by 2 pi/3 radians of angular displacement of rotation of cam drive shaft 11; and by making the proper selection of cam lobe geometry in combination with cam follower geometry.

The preferred means to operate the cam followers 14A, 14B, and 14C such that their operating cycles are identical and separated by 2 pi/3 radians of angular displacement is shown in FIG. 1A. Said cam followers are evenly spaced around the central axis of rotation of cam drive shaft 11 separated by 2 pi/3 radians of angular displacement; and said cam followers are also equidistant from the central axis of rotation of cam drive shaft 11 with respect to the radial direction when displaced to their minimum radial positions.

An alternative means to operate the cam followers 14A, 14B, and 14C such that their operating cycles are identical and separated by 2 pi/3 radians of angular displacement is shown in FIG. 1B. Said cam followers are each operated by individual cam lobes 12A, 12B, and 12C. Said cam lobes are identical to each other with respect to their profiles of radius versus angular displacement around them; for a common reference point on the profile of each of said cam lobes, each of said cam lobes is suitably operatively joined to cam drive shaft 11 and offset with respect to the other two by 2 pi/3 radians of angular displacement of cam driveshaft rotation.

The means shown in FIG. 1A to displace cam followers 14A, 14B, and 14C is preferred due to its simplicity of design, lower cost to manufacture, and to the certainty that each of the radial displacement cycles of said cam followers will be identical. Said complex means shown in FIG. 1B is considered disadvantageous since each of cam lobes 12A, 12B, and 12C must be made identical to difficult manufacturing tolerances.

Cam lobe geometry in combination with cam follower geometry is chosen such that the sum of the radial velocities of cam followers 14A, 14B, and 14C in the outward (increasing) radial direction is maintained constant, and likewise the sum of the radial velocities of cam followers 14A, 14B, and 14C in the inward (decreasing) radial direction is maintained constant. Said net constant sum outward radial velocity results in displacement of hydraulic pistons 16A, 16B, and 16C which provide a net constant rate of delivery of hydraulic fluid into fluid transducers 22, 18, and 20, and likewise said net constant sum inward radial velocity results in displacement of hydraulic pistons 16A, 16B, and 16C which provide a net constant rate of withdrawal of hydraulic fluid from fluid transducers 22, 18, and 20.

Said net constant rate of delivery of hydraulic fluid into fluid transducers 22, 18, and 20 and net constant rate of withdrawal of hydraulic fluid from fluid transducers 22, 18, and 20 is accomplished simultaneously and continuously by alternating the functions of withdrawal from and delivery to said fluid transducers via rotation of said cam lobe means.

Overlap of said delivery cycle between consecutively operating fluid transducers occurs in order to make a gradual transition of the delivery function from one fluid transducer to the next; and likewise overlap of said withdrawal cycle between consecutively operating fluid transducers occurs in order to make a gradual transition of the withdrawal function from one fluid transducer to the next. In this manner, a net constant rate of delivery of hydraulic fluid into fluid transducers 22, 18, and 20 and a net constant rate of withdrawal of hydraulic fluid from fluid transducers 22, 18, and 20 is maintained.

Figure 6:
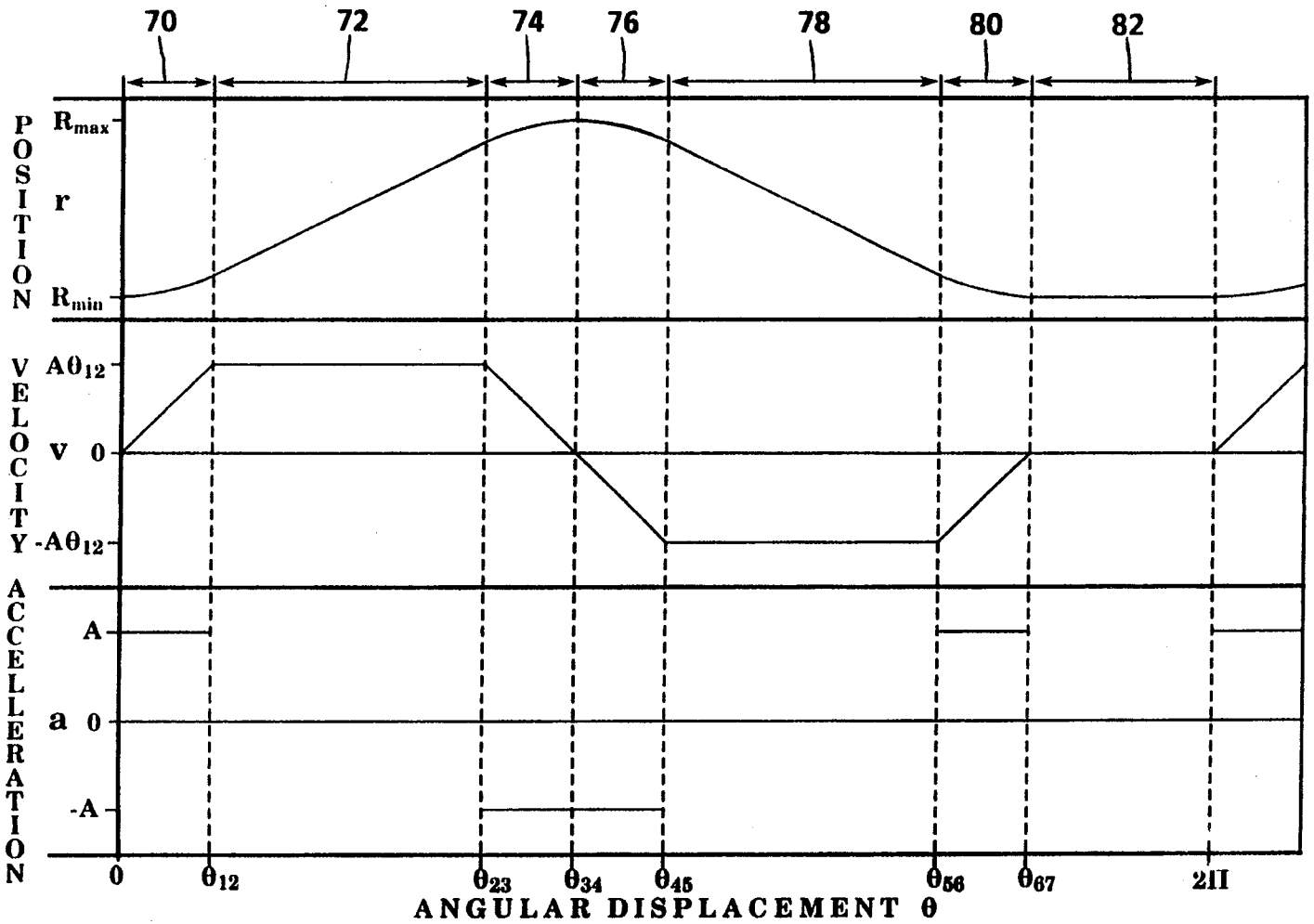
FIG. 6 is a graphical representation of the relationship between acceleration, velocity, and radial position of a cam follower as it is displaced by a cam lobe.

The preferred geometry of cam lobe 12 in FIG. 1A is chosen such that the radial motion of each of said cam followers 14A, 14B, and 14C may be graphically represented by FIG. 6, with each of said cam followers operating 2 pi/3 radians of angular displacement apart with respect to the rotation of cam driveshaft 11 in FIG. 1A. FIG. 6 depicts the radial acceleration a, velocity v, and position r of a cam follower produced by rotation of a cam lobe at unit angular velocity; thus the abscissa of FIG. 6 is in units of angular displacement of cam drive shaft rotation.

Referring to FIG. 6, to minimize the complexity of the design of said cam lobe, the preferred geometry of said cam lobe is chosen to produce a period 70 of constant radial acceleration A of said cam follower, starting at zero radial velocity and increasing to a velocity of $A\theta_{12}$; followed by a period 72 of constant outward radial velocity $A\theta_{12}$ of said cam follower; followed by a period 74 of constant radial deceleration $-A$ of said cam follower, starting at $A\theta_{12}$ radial velocity and decreasing to a velocity of zero; followed by a period 76 of constant radial deceleration $-A$ of said cam follower, starting at zero radial velocity and decreasing to a velocity of $-A\theta_{12}$; followed by a period 78 of constant inward radial velocity $-A\theta_{12}$ of said cam follower; followed by a period 80 of constant radial acceleration A of said cam follower, starting at $-A_{12}$ radial velocity and increasing to a velocity of zero; followed by a period 82 of zero radial velocity for the remaining portion of angular displacement to complete 2 pi radians of cam drive shaft rotation.

The applicant's pump may be designed such that a plurality of cam followers are operated as described in FIG. 6 to effect the pumping action. For a cam system of n cam followers, the operational cycles of the cam followers must sequentially differ by increments of 2 pi/n radians. In the preferred embodiment, three cam followers are employed to achieve maximum simplicity in pump design. Referring to FIG. 6, for a pump employing three cam followers, the sum of periods 70, 72, 74, 76, 78, and 80 must be less than 2 pi radians and greater than 4 pi/3 radians. Values near the lower limit will require high rates of cam follower acceleration, and thus are not practical.

It may also be seen from FIG. 6 that the intervals 70, 72, and 74 correspond to an overall period of positive (outward) cam follower velocity occurring from zero to $\theta_{34}$ of angular displacement, and thus a delivery of hydraulic fluid into a fluid transducer occurs during this interval. Likewise, the intervals 76, 78, and 80 correspond to an overall period of negative (inward) cam follower velocity occurring from $\theta_{34}$ to $\theta_{67}$ of angular displacement, and thus a withdrawal of hydraulic fluid from a fluid transducer occurs during this interval.

For each of these overall intervals of delivery and withdrawal, the duration of periods 72 and 78 of constant cam follower velocity may be zero, with the periods composed entirely of intervals of acceleration and deceleration of the cam follower. In the preferred embodiment of applicant's invention, an interval of constant cam follower velocity is between one and three times the duration of an interval of acceleration.

The interval of positive cam follower velocity from zero to $\theta_{34}$ and the interval of negative cam follower velocity from $\theta_{34}$ to $\theta_{67}$ of angular displacement are preferably equal in duration; periods of constant cam follower velocity 72 and 78 are preferably equal in duration; and the period 70 of cam follower acceleration is preferably equal to the period 76 of cam follower deceleration. Said preferences result in simplified cam lobe design.

In the preferred embodiment of design of said cam lobe, for a cam lobe rotating at unit angular velocity, the period 70 of constant radial acceleration A of said cam follower is pi/6 radians of angular displacement; the period 72 of constant outward radial velocity $A\theta_{12}$ of said cam follower is pi/2 radians of angular displacement; the period 74 of constant radial deceleration $-A$ of said cam follower is pi/6 radians of angular displacement; the period 76 of constant radial deceleration $-A$ of said cam follower is pi/6 radians of angular displacement; the period 78 of constant inward radial velocity $-A\theta_{12}$ of said cam follower is pi/2 radians of angular displacement; the period 80 of constant radial acceleration A of said cam follower is pi/6 radians of angular displacement; and the period 82 of zero radial velocity is pi/3 radians of angular displacement.

Figure 7:
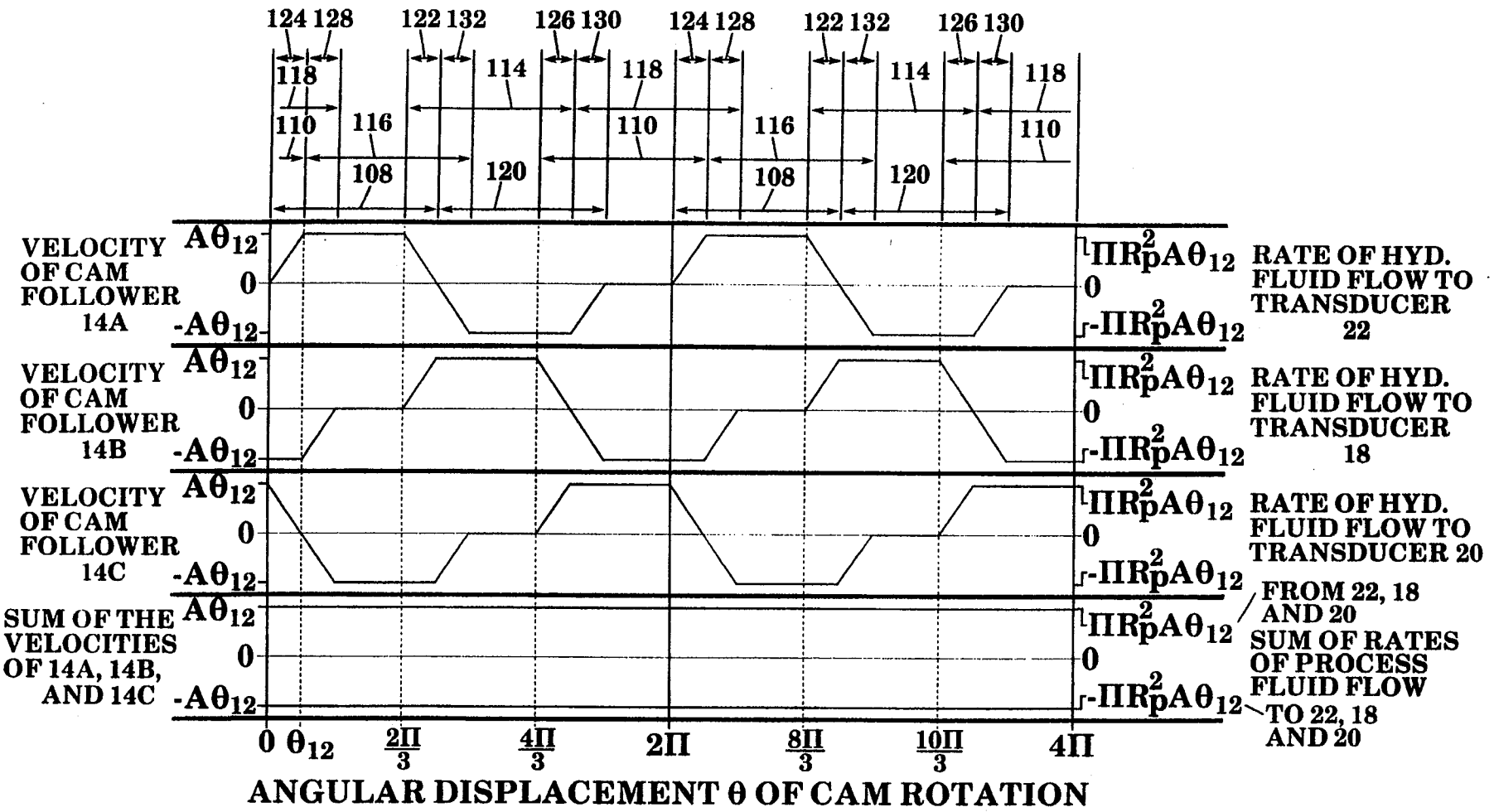
FIG. 7 is a graphical representation of the radial velocity of each cam follower, and the sum of said radial velocities (left vertical axis); and the corresponding hydraulic fluid flowrates to each transducer with the net sum of the rates of process fluid flow into and out of the fluid transducers (right vertical axis)

FIG. 7 is a graphical representation of the radial velocity of each of said preferred three cam followers, and the individual sums of the positive and negative components of said radial velocities (left vertical axis); and the corresponding hydraulic fluid flowrates to each transducer with the net sum of the rates of process fluid flow into and out of the fluid transducers (right vertical axis).

Referring to FIG. 7, it is seen that by sequencing the operating cycles of each of said preferred three cam followers by 2 pi/3 radians, a net constant sum of $A\theta_{12}$ is maintained as the positive component of cam follower velocity. Likewise, a net constant sum of $A\theta_{12}$ is maintained as the negative component of cam follower velocity.

For the resulting displacement of hydraulic pistons within cylindrical cavities of radius $R_p$ at a net constant sum positive velocity of $A\theta_{12}$, the net constant sum of fluid flow delivered to said three fluid transducers is $pi(R_p)^2A\theta_{12}$. Likewise, for a net constant sum negative velocity of $-A\theta_{12}$, the net constant sum of fluid flow withdrawn from said three fluid transducers is $-pi(R_p)^2A\theta_{12}$ with the negative sign denoting inward cam follower radial velocity, and withdrawal of hydraulic fluid from said fluid transducers.

Referring to FIG. 1A, it may now be understood that through use of the above prescribed motion for cam followers 14A, 14B, and 14C, a constant rate of delivery of hydraulic fluid into fluid transducers 22, 18, and 20 is maintained; and a constant rate of withdrawal of hydraulic fluid from fluid transducers 22, 18, and 20 is maintained. Thus a corresponding constant rate of flow of process fluid from reservoir 36 through valve means 32, 24, and 26 into fluid transducers 22, 18, and 20 is maintained; and a constant rate of flow of process fluid from fluid transducers 22, 18, and 20 through valve means 34, 26, and 30 to the desired destination indicated by arrow 35 is maintained.

Thus it can be understood that applicant's pump maintains a constant rate of flow of process fluid from reservoir 36 to the desired destination indicated by arrow 35.

An alternative cam lobe geometry may be used to achieve substantially the same result of constant flow of fluid as described above. Referring to FIG. 6 which depicts in the top graph the radial position of a cam follower during a full rotation of the cam drive shaft through 2 pi radians, it can be understood that radial position of the cam follower is at a minimum value $R_{min}$ at zero angular displacement, then increases to a maximum value at $R_{max}$ at $\theta_{34}$ radians of angular displacement, then decreases to a minimum value of $R_{min}$ at $\theta_{67}$ radians of angular displacement, and is maintained at a minimum value of $R_{min}$ for the duration of the rotational cycle through 2 pi radians, FIG. 8B is an axial view of an alternative embodiment of a cam lobe projected on a polar coordinate system which may be used to achieve substantially the same result of constant flow of fluid as described above, Cam lobe 84 differs from cam lobe 85 which is shown as the preferred embodiment in FIG. 8A in that the period of zero cam follower velocity in cam lobe 85 occurs when the radial position of a cam follower is at its minimum value $R_{min}$; conversely, the period of zero cam follower velocity in cam lobe 84 occurs when the radial position of a cam follower is at its maximum value $R_{max}$.

Figure 8A:
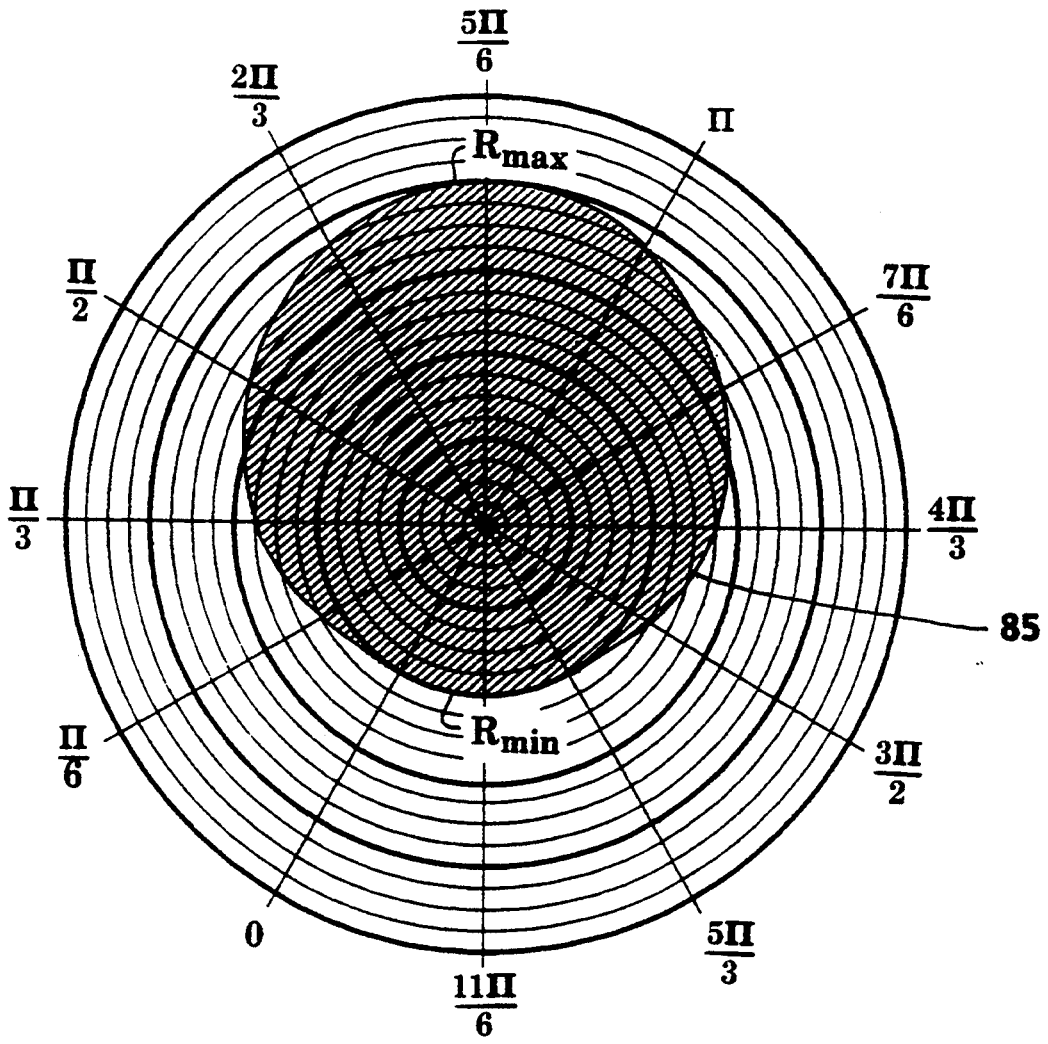
FIG. 8A is an axial view of one embodiment of a cam lobe projected on a polar coordinate system.
Figure 8B:
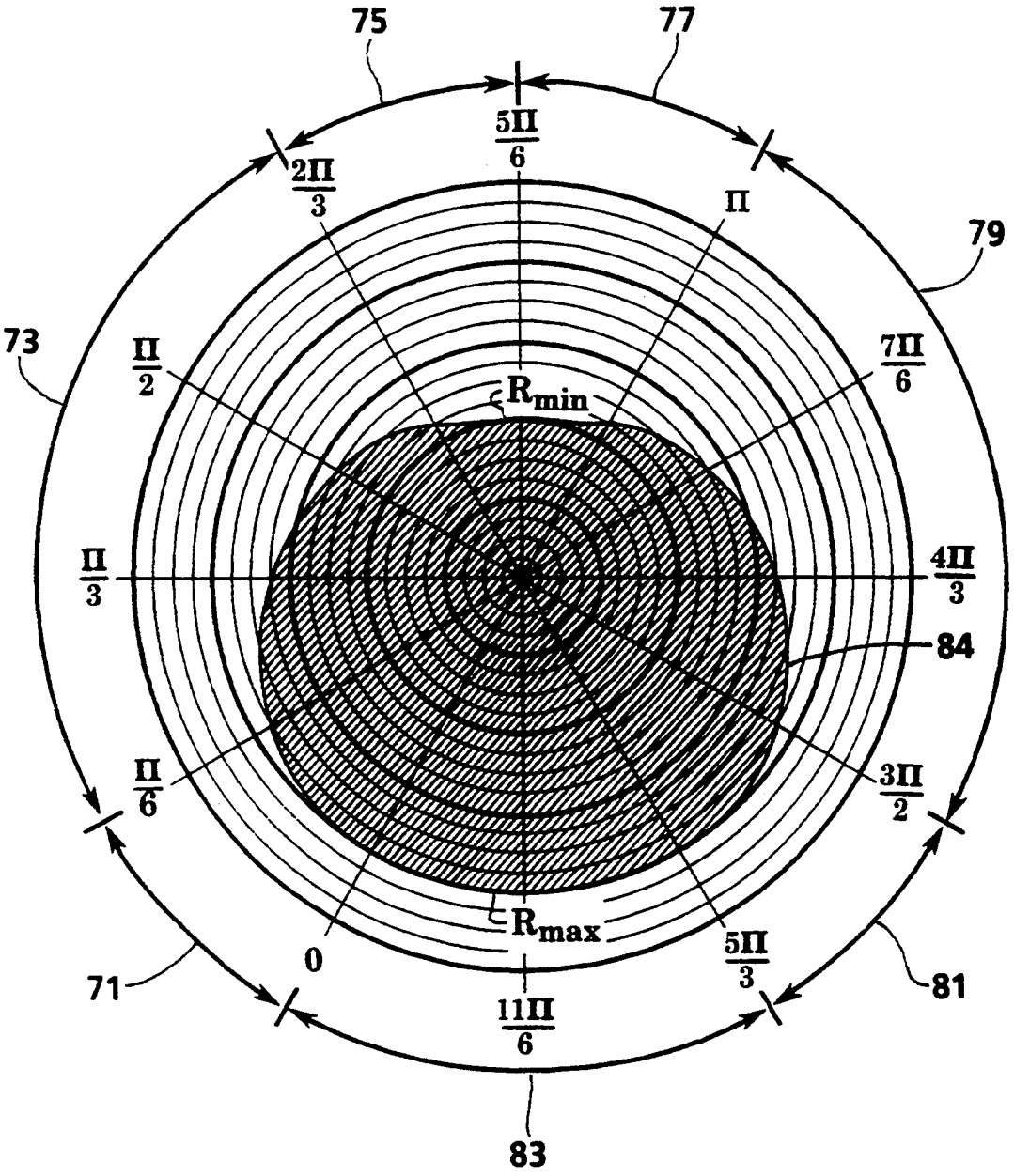
FIG. 8B is an axial view of an alternative embodiment of a cam lobe projected on a polar coordinate system.

Thus a complete cycle of 2 pi radians of operation of cam lobe 84 would begin with a cam follower at position $R_{max}$ at zero radians followed by a sector 71 of constant radial deceleration of said cam follower, starting at zero radial velocity and decreasing to a desired velocity; followed by a sector 73 of constant inward radial velocity of said cam follower; followed by a sector 75 of constant radial acceleration of said cam follower, increasing to a velocity of zero and a radial position of $R_{min}$; followed by a sector 77 of constant radial acceleration of said cam follower, starting at zero radial velocity and increasing to a desired velocity; followed by a sector 79 of constant outward radial velocity of said cam follower; followed by a sector 81 of constant radial deceleration of said cam follower to a velocity of zero; followed by a sector 83 of zero radial velocity and a radial position of $R_{max}$ for the remaining portion of angular displacement to complete 2 pi radians of cam drive shaft rotation, The net result of the use of cam lobe 84 in FIG. 8B is to reverse the cycle of operation of that of cam lobe 85 in FIG. 8A. When cam lobe 85 is rotated counterclockwise to displace a cam follower, the operational cycle is delivery of hydraulic fluid to a fluid transducer, followed by withdrawal of hydraulic fluid from a fluid transducer, followed by an interval of no hydraulic fluid flow to the fluid transducer.

Conversely, when cam lobe 84 is rotated counterclockwise to displace a cam follower, the operational cycle is withdrawal of hydraulic fluid from a fluid transducer, followed by delivery of hydraulic fluid to a fluid transducer, followed by an interval of no hydraulic fluid flow to the fluid transducer.

It is understood that both embodiments of said cam lobes achieve substantially the same result when used as previously described in this disclosure.

Because of the unique design of applicant's preferred embodiment of cam lobe and cam follower, a constant flowrate of fluid can be provided by applicant's invention. FIG. 9A is an axial view of the contact of a roller type cam follower with a cam lobe of the applicant's invention; and FIG. 9B is a detailed rendering of the actual contact point of a cam follower with a cam lobe shown in FIG. 9A. Referring to FIG. 9A, it will be understood that cam follower 14 is maintained in contact with cam lobe 12 via roller means 62. Cam follower 14 is one of three cam followers (others not shown) placed at 2 pi/3 radian intervals shown by dotted lines 63A, 63B, and 63C around central axis of rotation 13 of cam drive shaft 11. Said cam follower 14 has a central axis along its length which is maintained colinear with said dotted line 63B.

By referring to FIG. 9B, it will be further understood that for all points around the cam lobe for which cam radius is changing, the contact point 64 between roller means 62 and cam lobe 12 is not colinear with central axis of said cam follower 14, represented by dotted line 63B. Those points for which cam radius is changing include sections circumferentially around cam lobe 12 for which the velocity of cam follower 14 is non-zero. Thus sections of radial acceleration, deceleration, and constant non zero velocity are included; said sections thus consist of the entire cycle of reciprocating motion of cam follower 14, with the exception of the point of reversal of direction between outward radial motion and inward radial motion of said cam follower.

It will also be further understood that when cam follower is in contact with cam lobe 12 and has a non-zero velocity, there will exist a spatial gap 65 between the intersection 69A of the central axis 63B of cam follower 14 with roller means 62 and the intersection 69B of the central axis 63B with cam lobe 12.

Prior art pumps described in U.S. Pat. Nos. 4,556,371 of Post; 4,687,426 of Yoshimura; and 4,790,732 of Yamatani all prescribe a cam lobe geometry which consists of sections of radial acceleration, velocity, and deceleration, in combination with cam followers with roller means. Thus said prior art pumps reciprocate cam followers whose radial motion does not sum to the desired constant inward and outward velocities, and thus can not pump liquid at a substantially constant flow rate.

In the preferred embodiment of cam lobe geometry for use in applicant=s invention, a correction is applied in the manufacture of cam lobe 12 such that the desired sequences of radial acceleration, constant velocity, and deceleration of the cam followers are achieved as previously described and illustrated in FIGS. 6 and 7. The magnitude of said correction is dependent on the overall size of said cam lobe, the size of said roller means, and the desired rates of acceleration and velocity of said cam followers during an operational cycle. Said magnitude of said correction may be obtained either experimentally, or via the use of analytic geometry and the calculus.

In an alternative embodiment of said cam follower means, said correction is rendered unnecessary. Referring to FIG. 9C, it will be understood that the use of a sharp edged cam follower 67 will maintain its point of contact 68 with cam lobe colinear with the central axis 63B of cam follower 67. Thus cam follower 67 accurately follows the radial variations of the surface of cam lobe 12. In this embodiment of cam lobe 12 and cam follower 67, it is necessary to provide for the minimization of wear between said two components via the use of hard coatings of diamond, titanium nitride, silicon carbide, or other suitable means known to those skilled in the art. Alternatively, lubricating coatings or impregnation of said component surfaces with Teflon (trademark of DuPont) or other suitable means may be used to minimize said wear between said cam lobe and said cam follower.

It will be apparent to one skilled in the art that an alternative embodiment of cam follower means in which said cam follower has a flat contact surface similar to those cam followers used in automotive engines can be used, provided that proper correction is made to said cam lobe surface geometry.

Because of the unique design of applicant's preferred embodiments of cam lobe and cam followers, the transition between the time when fluid is delivered to or withdrawn from one fluid transducer, and delivered to or withdrawn from a second fluid transducer, is a smooth one, insuring a relatively constant flow rate, and substantial acceleration of the process fluid being pumped is avoided. Thus, the apparatus of applicant's invention allows one to pump fluid without subjecting it to a substantial amount of shear.

In applicant's preferred embodiment, at no point during the pumping cycle is the process fluid subjected to shear due to rapid movement of any mechanical components which are in close proximity to one another.

The apparatus of applicant's invention also allows one to provide a substantially constant flow rate of process fluid. As used in this specification, the term substantially constant flow rate refers to a flow rate which, preferably, does not vary more than 1.0 percent at any time during the pumping cycle. This substantially constant flow rate of process fluid from metering pump 10, indicated by arrow 35 in FIG. 1A, is accomplished through the use of rotating cam lobe 12 which sequentially radially displaces cam followers 14A, 14B, and 14C, and pistons 16A, 16B, and 16C which in turn provide a correspondingly substantially constant flow rate of hydraulic fluid into one or two of fluid transducers 22, 18, or 20, while simultaneously withdrawing a correspondingly substantially constant flow rate from one or two of fluid transducers 22, 18, or 20, which is not receiving hydraulic fluid.

Figure 10:
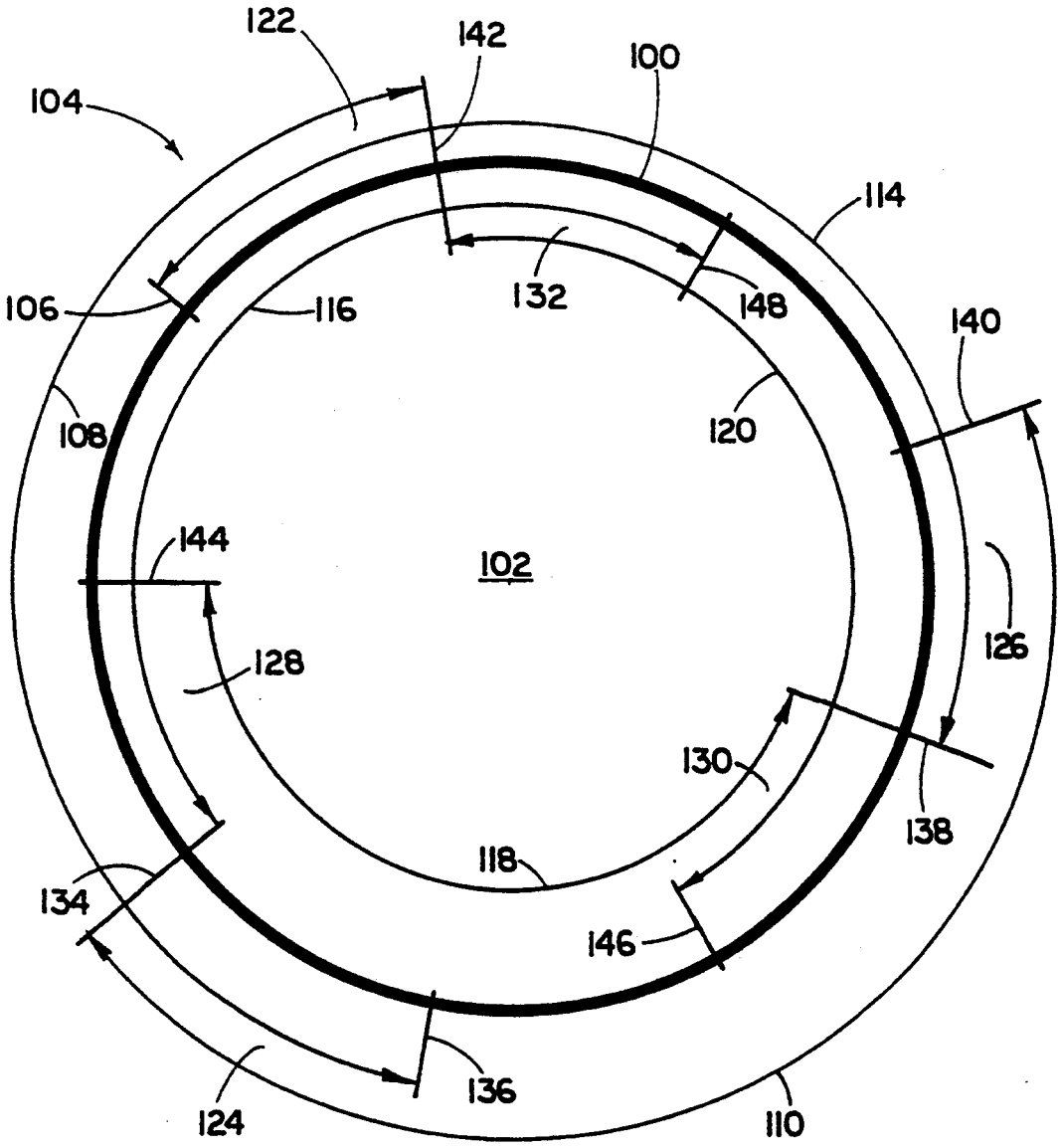
FIG. 10 is a representation of the timing of fluid flow into and out of the fluid transducers 22, 18, and 20 in FIG. 1A produced by the cam lobe 12 through a complete 360 degree cycle of operation.

By way of further illustration, FIG. 10 represents a timing cycle for the operation of a preferred embodiment of my co-pending application Ser. No. 07/710,323, which employs a rotary gear pump and a rotary timing valve in combination with fluid transducer means. FIG. 10 in conjunction with FIG. 7 may also be used to represent and teach the timing cycle for the operation of said metering pump in this disclosure.

Referring to FIG. 10, circle 100 represents a timing cycle through 2D radians of cam drive shaft rotation. A traversal clockwise around circle 100 represents the timing of sequential operation of fluid transducers 22, 18, and 20 via counter clockwise operation of cam lobe 12 which sequentially reciprocates cam followers 14A, 14B, and 14C, shown in FIG. 1A. Said circle 100 also correlates with the graphical representation of said fluid transducers shown in FIG. 7 for 2 pi radians of cam drive shaft rotation.

The cycle of delivery of hydraulic fluid to said fluid transducers may be understood by consideration of the outside of circle 100, commencing with line 136 in FIG. 10, which corresponds to the zero radian starting point of the operating cycle.

Proceeding clockwise around the outside of circle 100, arc 108 represents the interval of delivery of hydraulic fluid to fluid transducer 22 in FIG. 1A, also depicted by line 108 in FIG. 7. Arc 114 represents the interval of delivery of hydraulic fluid to fluid transducer 18 in FIG. 1A, also depicted by line 114 in FIG. 7. Interval 122 in FIG. 10 and line 122 in FIG. 7 represent a zone of overlap between delivery of hydraulic fluid to fluid transducer 22 and delivery of hydraulic fluid to fluid transducer 18, both in FIG. 1A, during which the flowrate of hydraulic fluid to fluid transducer 22 decreases from a previously constant flow rate to zero, and the flowrate of hydraulic fluid to fluid transducer 18 increases from zero to a desired constant flow rate. During this interval, cam follower 14A is decelerating to a zero velocity, and cam follower 14B is accelerating from zero to a desired velocity.

Thus it will be understood that a smooth transition occurs between delivery of hydraulic fluid flow to fluid transducer 22 and delivery of hydraulic fluid flow to fluid transducer 18, and a net constant sum of flow of hydraulic fluid is maintained to said fluid transducers.

Continuing clockwise around circle 100 from line 140, arc 110 represents the interval of delivery of hydraulic fluid to fluid transducer 20 in FIG. 1A, also depicted by line 110 in FIG. 7.

Interval 126 in FIG. 10 and line 126 in FIG. 7 represent a zone of overlap between delivery of hydraulic fluid to fluid transducer 18 and delivery of hydraulic fluid to fluid transducer 20, both in FIG. 1A, during which the flowrate of hydraulic fluid to fluid transducer 18 decreases from a previously constant flow rate to zero, and the flow rate of hydraulic fluid to fluid transducer 20 increases from zero to a desired constant flow rate. During this interval, cam follower 14B is decelerating to a zero velocity, and cam follower 14C is accelerating from zero to a desired velocity.

Thus it will be understood that a smooth transition occurs between delivery of hydraulic fluid flow to fluid transducer 18 and delivery of hydraulic fluid flow to fluid transducer 20, and a net constant sum of flow of hydraulic fluid is maintained to said fluid transducers. Continuing clockwise around circle 100 from line 136, interval 124 in FIG. 10 and line 124 in FIG. 7 represent a zone of over lap between delivery of hydraulic fluid to fluid transducer 20 and delivery of hydraulic fluid to fluid transducer 22, both in FIG. 1A, during which the flowrate of hydraulic fluid to fluid transducer 20 decreases from a previously constant flow rate to zero, and the flowrate of hydraulic fluid to fluid transducer 22 increases from zero to a desired constant flow rate. During this interval, cam follower 14C is decelerating to a zero velocity, and cam follower 14A is accelerating from zero to a desired velocity.

Thus it will be understood that a smooth transition occurs between delivery of hydraulic fluid flow to fluid transducer 20 and delivery of hydraulic fluid flow to fluid transducer 22, and a net constant sum of flow of hydraulic fluid is maintained to said fluid transducers.

Referring to FIG. 1A, thus it will be further understood that a constant net sum flow of hydraulic fluid is maintained delivered to said fluid transducers 22, 18, and 20, and a corresponding equal constant net sum flow of process fluid is maintained from fluid transducers 22, 18, and 20 through valve means 34, 26, and 30 through conduit means 43A, 43B, and 43C to a desired location indicated by arrow 35.

In like manner, the cycle of withdrawal of hydraulic fluid from said fluid transducers may be understood by consideration of the inside of circle 100, commencing with line 142 in FIG. 10.

Proceeding clockwise around the inside of circle 100 from line 142, arc 120 represents the interval of withdrawal of hydraulic fluid from fluid transducer 22 in FIG. 1A, also depicted by line 120 in FIG. 7. Arc 118 represents the interval of withdrawal of hydraulic fluid from fluid transducer 18 in FIG. 1A, also depicted by line 118 in FIG. 7.

Interval 130 in FIG. 10 and line 130 in FIG. 7 represent a zone of overlap between withdrawal of hydraulic fluid from fluid transducer 22 and withdrawal of hydraulic fluid from fluid transducer 18, both in FIG. 1A, during which the flowrate of hydraulic fluid from fluid transducer 22 decreases from a previously constant flow rate to zero, and the flowrate of hydraulic fluid from fluid transducer 18 increases from zero to a desired constant flow rate. During this interval, cam follower 14A is accelerating to a zero velocity from a negative (radially inward) velocity, and cam follower 14B is decelerating from zero to a negative (radially inward) desired velocity.

Thus it will be understood that a smooth transition occurs between withdrawal of hydraulic fluid flow from fluid transducer 22 and withdrawal of hydraulic fluid flow from fluid transducer 18, and a net constant sum of flow of hydraulic fluid is maintained from said fluid transducers.

Continuing clockwise around circle 100 from line 134, arc 116 represents the interval of withdrawal of hydraulic fluid from fluid transducer 20 in FIG. 1A, also depicted by line 116 in FIG. 7.

Interval 128 in FIG. 10 and line 128 in FIG. 7 represent a zone of overlap between withdrawal of hydraulic fluid from fluid transducer 18 and withdrawal of hydraulic fluid from fluid transducer 20, both in FIG. 1A, during which the flowrate of hydraulic fluid from fluid transducer 18 decreases from a previously constant flow rate to zero, and the flowrate of hydraulic fluid from fluid transducer 20 increases from zero to a desired constant flow rate. During this interval, cam follower 14B is accelerating to a zero velocity from a negative (radially inward) velocity, and cam follower 14C is decelerating from zero to a negative (radially inward) desired velocity.

Thus it will be understood that a smooth transition occurs between withdrawal of hydraulic fluid flow from fluid transducer 18 and withdrawal of hydraulic fluid flow from fluid transducer 20, and a net constant sum of flow of hydraulic fluid is maintained from said fluid transducers.

Continuing clockwise around circle 100 from line 142, interval 132 in FIG. 10 and line 132 in FIG. 7 represent a zone of overlap between withdrawal of hydraulic fluid from fluid transducer 20 and withdrawal of hydraulic fluid from fluid transducer 22, both in FIG. 1A, during which the flowrate of hydraulic fluid from fluid transducer 20 decreases from a previously constant flow rate to zero, and the flowrate of hydraulic fluid from fluid transducer 22 increases from zero to a desired constant flow rate. During this interval, cam follower 14C is accelerating to a zero velocity from a negative (radially inward) velocity, and cam follower 14C is decelerating from zero to a negative (radially inward) desired velocity.

Thus it will be understood that a smooth transition occurs between withdrawal of hydraulic fluid flow from fluid transducer 20 and withdrawal of hydraulic fluid flow from fluid transducer 22, and a net constant sum of flow of hydraulic fluid is maintained from said fluid transducers.

Referring to FIG. 1A, thus it will be further understood that a constant net sum flow of hydraulic fluid is maintained withdrawn from said fluid transducers 22, 18, and 20, and a corresponding equal constant net sum flow of process fluid is maintained taken into fluid transducers 22, 18, and 20 through valve means 32, 24, and 28 from reservoir 36.

It will be apparent to those skilled in the art that, although the operation of cam lobe 12 in FIG. 1A has been described with counterclockwise rotation, substantially the same results are obtained with clockwise rotation of said cam lobe.

Referring again to FIG. 1A, the operation of applicant's preferred metering pump 10 will now be described. Before the start of operation, hydraulic fluid is filled into cylindrical cavities 15A, 15B, and 15C, conduit means 42A, 428, and 42C, and the lower chambers of fluid transducers 22, 18, and 20 via conventional means.

Upon operation, cam drive shaft 11 rotates cam lobe 12, which sequentially reciprocates cam followers 14A, 148, and 14C radially inward and outward. The geometric shape of said cam lobe 12 is such that the net sum of positive (outward) radial components of velocity of cam followers 14A, 148, and 14C is constant through a full 2 pi radians of rotation of cam lobe 12 when cam lobe 12 is rotated at constant angular velocity. Likewise, the net sum of negative (inward) radial components of velocity of cam followers 14A, 148, and 14C is constant through a full 2 pi radians of rotation of cam lobe 12 when cam lobe 12 is rotated at constant angular velocity.

Thus hydraulic pistons 16A, 168, and 16C reciprocate in hydraulic cylinders 17A, 178, and 17C with identical velocity constraints, thereby displacing a net constant sum flow of hydraulic fluid to one or two of fluid transducers 22, 18, and 20, while simultaneously withdrawing a net constant sum flow of hydraulic fluid from one or two of fluid transducers 22, 18, and 20.

Thus through the operation of fluid transducers 22, 18, and 20 described elsewhere in this specification, a net constant sum flow of process fluid from one or two of fluid transducers 22, 18, and 20 through valve means 34, 26, and 30, through conduit means 43A, 438, and 43C to a desired location indicated by arrow 35 is maintained, while simultaneously a net constant sum flow of process fluid withdrawn from reservoir 36, through valve means 32, 24, and 28, and, subsequently, into one or two of fluid transducers 22, 18, and 20 is maintained.

Although check valves have been illustrated in FIGS. 1A and 1B for valving means 24, 26, 28, 30, 32, and 34, it will be appreciated by those skilled in the art that other suitable valve means may also be used. Thus, for example, one also may use single three-way valve means coupled with control means, or pairs of two-way valve means coupled with control means, and the like.

Thus, it will be appreciated by those skilled in the art that, because of applicant's unique combination of cam lobe 12, cam followers 14A, 14B, and 14C, hydraulic pistons 16A, 16B, and 16C, hydraulic cylinders 17A, 17B, and 17C, and fluid transducers 22, 18, and 20, there occurs a substantially constant output of the process fluid through line 45 and, concurrently, a substantially constant and equal withdrawal of the process fluid from reservoir 36, without requiring such process fluid to be subjected to substantial acceleration or shear.

The following example is presented to illustrate the claimed invention but is not to be deemed limitative thereof. Unless otherwise specified, all parts are by weight and all temperatures are in degrees centigrade.

Example 1

By way of further illustration, an example of applicant's metering pump is provided. Said metering pump is to have a capacity of between minimum 200 and maximum 4000 cubic centimeters per minute (cm3/min). Maximum drive rotational speed for the cam lobe is chosen to be 120 revolutions per minute (RPM). Maximum pump output is related to pump design parameters by the following expression:

maximum = maximum cam RPM × fluid volume displaced per flowrate cam drive shaft revolution This can be expressed mathematically as $$Q = RPM \times n\Pi R_p^2 \times (R_{max} - R_{min})$$

where

RPM = cam rotational speed, revolutions per minute n = the number of cam followers and hydraulic pistons $R_p$ = radius of a hydraulic piston, cm $R_{max}$ = maximum radius of a cam lobe, cm $R_{min}$ = minimum radius of a cam lobe, cm Q = output flowrate of process fluid, cm3/minute For a desired output maximum flowrate of 4000 $cm^3$/minute, maximum cam rotational speed of 120 RPM, and the preferred three sets of cam followers and hydraulic pistons, the radius of hydraulic pistons $R_p$ is chosen to be 1.330 cm, $R_{max}$ is chosen to be 4.00 cm, $R_{min}$ is chosen to be 2.00 cm, and cam roller radius is chosen to be 1.00 cm.

The preferred cam lobe geometry is chosen such that sectors of the cam lobe which produce cam follower accelleration A or deceleration −A are Π/6 radians; and sectors which produce constant cam follower velocity are Π/2 radians. Thus it may be calculated that for a cam lobe rotating at unit angular velocity which reciprocates the cam followers a radial displacement of $R_{max} - R_{min} = 2$ cm of stroke, the required cam follower accelleration is $18/\Pi^2$ cm/radian$^2$, the required cam follower decelleration is $-18/\Pi^2$ cm/radian$^2$, the required cam follower positive constant velocity is 3/Πcm/radian, and the required cam follower negative constant velocity is −3/Πcm/radian.

A cam lobe is fabricated which is matched to the cam followers and displaces the cam followers radially according to the following table (refer to FIG. 6):

TABLE 1

| Angular Displacement (radians) | Cam follower radial position (cm) |
|---|---|
| 0 | 0 |
| $0<\theta<\pi/6$ | $2 + 9\theta^2/\pi^2$ |
| $\pi/6$ | 2.25 |
| $\pi/6<\theta<2\pi/3$ | $2.25 + (3/\pi)(\theta - \pi/6)$ |
| $2\pi/3$ | 3.75 |
| $2\pi/3<\theta<5\pi/6$ | $3.75 + (15/\pi)(\theta - 2\pi/3) - (18/\pi^2)(\theta^2/2 - 2\pi^2/9)$ |
| $5\pi 6$ | 4.00 |

TABLE 1-continued

| Angular Displacement (radians) | Cam follower radial position (cm) |
|---|---|
| $5\pi/6<\theta<\pi$ | $4.00-(9/\pi^2)(\theta^2-25\pi^2/36)+(15/\pi)(\theta-5\pi/6)$ |
| $\pi$ | 3.75 |
| $\pi<\theta<3\pi/2$ | $3.75-(3/\pi)(\theta-\pi)$ |
| $3\pi/2$ | 2.25 |
| $3\pi/2<\theta<5\pi/3$ | $2.25-(30/\pi)(\theta-3\pi/2)+(9/\pi^2)(\theta^2-9\pi^2/4)$ |
| $5\pi/3$ | 2.00 |
| $5\pi/3<\theta<2\pi$ | 2.00 |

It is to be understood that the aforementioned description is illustrative only and that changes can be made in the apparatus, the ingredients and their proportions, and in the sequence of combinations and process steps, as well as in other aspects of the invention discussed herein, without departing from the scope of the of invention as defined in the claims.

I claim:

1. An apparatus for pumping fluid at a substantially constant flow rate, wherein said apparatus is comprised of:

(a) a first fluid transducer means for hydraulically coupling a hydraulic fluid to another fluid while preventing said hydraulic fluid from contacting said other fluid;

(b) a second fluid transducer means for hydraulically coupling a hydraulic fluid to another fluid while preventing said hydraulic fluid from contacting said other fluid;

(c) a third fluid transducer means for hydraulically coupling a hydraulic fluid to another fluid while preventing said hydraulic fluid from contacting said other fluid;

(d) timing means for continuously and sequentially withdrawing hydraulic fluid from said first fluid transducer means while simultaneously pumping hydraulic fluid to said second fluid transducer means, and thereafter withdrawing hydraulic fluid from said second fluid transducer means while simultaneously pumping hydraulic fluid to said third fluid transducer means, and thereafter withdrawing hydraulic fluid from said third fluid transducer means, wherein said timing means is comprised of:

1. a first hydraulic cylinder assembly comprised of a first hydraulic cylinder and a first piston reciprocably movable within said first cylinder;
2. a second hydraulic cylinder assembly comprised of a second hydraulic cylinder and a second piston reciprocably movable within said second cylinder;
3. a third hydraulic cylinder assembly comprised of a third hydraulic cylinder and a third piston reciprocably movable within said third cylinder;
4. cam follower means for reciprocably moving said first piston within said first cylinder, said second piston within said second cylinder, and said third piston within said third cylinder;
5. cam lobe means for moving said cam follower means,
6. means for maintaining continuous contact between said cam follower means and said cam lobe means;

(e) means for hydraulically connecting said first hydraulic cylinder with said first fluid transducer;

(f) means for hydraulically connecting said second hydraulic cylinder with said second fluid transducer; and (g) means for hydraulically connecting said third hydraulic cylinder with said third fluid transducer.

2. The apparatus as recited in claim 1, wherein said timing means is comprised of means for moving said first piston, said second piston, and said third piston so that, at any point in time, the sum of the velocities of all of such pistons which are moving radially away from the axis of rotation of said cam lobe is constant.

3. The apparatus as recited in claim 2, wherein said timing means is comprised of means for moving said first piston, said second piston, and said third piston so that, at any point in time, the sum of the velocities of all of such pistons which are moving radially towards the axis of rotation of said cam lobe is constant.

4. The apparatus as recited in claim 3, wherein said timing means is comprised of one cam lobe.

5. The apparatus as recited in claim 4, wherein each of said first piston, said second piston, and said third piston is contiguous with said cam lobe and is disposed around the perimeter of said cam lobe at intervals of 120 degrees with respect to the central axis of rotation of said cam lobe.

6. The apparatus as recited in claim 3, wherein said timing means is comprised of three cam lobes.

7. The apparatus as recited in claim 6, wherein each of said three cam lobes has an identical shape and size.

8. The apparatus as recited in claim 7, wherein each of said three cam lobes is operatively connected to a separate cam follower, said apparatus being comprised of a first cam follower, a second cam follower, and a third cam follower.

9. The apparatus as recited in claim 8, wherein each of said first cam lobe, said second cam lobe, and said third cam lobe are operatively connected to a single drive shaft.

10. The apparatus as recited in claim 9, wherein said timing means is comprised of means for moving said first cam follower and said second cam follower so that the movement of said second cam follower is separated from the movement of said first cam follower by 120 degrees of said drive shaft rotation.

11. The apparatus as recited in claim 10, wherein said timing means is comprised of means for moving said second cam follower and said third cam follower so that the movement of said third cam follower is separated from the movement of said third cam follower by 120 degrees of said drive shaft rotation.

12. The apparatus as recited in claim 11, wherein said timing means is comprised of means for moving said third cam follower and said first cam follower so that the movement of said first cam follower is separated from the movement of said third cam follower by 120 degrees of said drive shaft rotation.

13. The apparatus as recited in claim 1, wherein said cam follower means is comprised of a roller and means for attaching said roller to the shaft of said cam follower.

14. The apparatus as recited in claim 1, wherein said cam follower means is comprised of means for maintaining contact between said cam follower and said cam lobe means along a line of contact parallel to the axis of rotation of said cam lobe means.

15. A timing device for continuously and sequentially withdrawing hydraulic fluid from a first fluid transducer means while simultaneously pumping hydraulic fluid to a second fluid transducer means, and thereafter withdrawing hydraulic fluid from said second fluid transducer means while simultaneously pumping hydraulic fluid to said a third fluid transducer means, and thereafter withdrawing hydraulic fluid from said third fluid transducer means, wherein said timing means is comprised of:

(a) a first load, a second load, and a third load;

(b) cam follower means for reciprocably moving said first load, said second load, and said third load;

(e) cam lobe means for moving said cam follower means;

(f) means for maintaining continuous contact between said cam follower means and said cam lobe means; and (g) means for moving said first load, said second load, and said third load so that, at any point in time, the sum of the velocities of all of such loads which are moving radially away from the axis of rotation of said cam lobe is constant.

16. The timing device as recited in claim 15, wherein said first load is a first hydraulic cylinder assembly comprised of a first hydraulic cylinder and a first piston reciprocably mounted within said first cylinder; said second load is a second hydraulic cylinder assembly comprised of a second hydraulic cylinder and a second piston reciprocably mounted within said second cylinder; and said third load is a third hydraulic cylinder assembly comprised of a third hydraulic cylinder and a third piston reciprocably mounted within said first cylinder.

17. A timing device for continuously and sequentially withdrawing hydraulic fluid from a first fluid transducer means while simultaneously pumping hydraulic fluid to a second fluid transducer means, and thereafter withdrawing hydraulic fluid from said second fluid transducer means while simultaneously pumping hydraulic fluid to said a third fluid transducer means, and thereafter withdrawing hydraulic fluid from said third fluid transducer means, wherein said timing means is comprised of:

(a) a first load, a second load, and a third load;

(b) cam follower means for reciprocably moving said first load, said second load, and said third load;

(e) cam lobe means for moving said cam follower means:

(f) means for maintaining continuous contact between said cam follower means and said cam lobe means; and (g) means for moving said first load, said second load, and said third load so that, at any point in time, the sum of the velocities of all of such loads which are moving radially towards the axis of rotation of said cam lobe is constant.

18. The timing device as recited in claim 17, wherein said first load is a first hydraulic cylinder assembly comprised of a first hydraulic cylinder and a first piston reciprocably mounted within said first cylinder; said second load is a second hydraulic cylinder assembly comprised of a second hydraulic cylinder and a second piston reciprocably mounted within said second cylinder; and said third load is a third hydraulic cylinder assembly comprised of a third hydraulic cylinder and a third piston reciprocably mounted within said first cylinder.

19. The timing device as recited in claim 18, wherein said timing device is comprised of means for moving said first load, said second load, and said third load so that, at any point in time, the sum of the velocities of all of such loads which are moving radially away from the axis of rotation of said cam lobe is constant.

* * * * *